US005769161A

United States Patent [19]

Borden

[11] Patent Number: 5,769,161

[45] Date of Patent: Jun. 23, 1998

[54] POLISHED ROD FOR OIL WELL PUMPING

[76] Inventor: B. Michael Borden, P.O. Box 1422, Sapulpa, Okla. 74067

[21] Appl. No.: 701,383

[22] Filed: Aug. 22, 1996

[51] Int. Cl.[6] ..... E21B 17/10

[52] U.S. Cl. ..... 166/72

[58] Field of Search ..... 403/299; 411/13; 166/68.5, 72, 46.1; 74/18.2

[56] References Cited

U.S. PATENT DOCUMENTS

| | | | |
|---|---|---|---|
| 838,448 | 12/1906 | Pitcher | 403/299 X |
| 2,259,191 | 10/1941 | Allen | 285/397 X |
| 2,419,453 | 4/1947 | Kocevar | 285/397 X |
| 3,955,822 | 5/1976 | Irby | 74/18.2 X |
| 4,938,285 | 7/1990 | Edwards et al. | 166/241.4 |

*Primary Examiner*—William P. Neuder
*Attorney, Agent, or Firm*—Head, Johnson & Kachigiar

[57] ABSTRACT

An improved polished rod for use in pumping a well has the characteristics of reducing inventory and warehouse space requirements. The polished rod is in the form of an elongated high strength cylindrical metal rod of uniform external diameter and adaptable for reciprocation in an oil well stuffing box, the exterior surface being adaptable to receive a clamp thereon by which the polished rod is reciprocated, and the polished rod having male threaded end portions at opposed first and second ends, either of which may be employed for threadable attachment to a female threaded upper end of a string of sucker rods suspended in a well. The first end portion having a thread of a first size for attachment to a sucker rod string having a female thread of mating size and the second end having a thread of a different, second size for attachment to a sucker rod string having a female thread of different, mating size whereby the polished rod may be employed for use with two different sizes of sucker rod strings.

6 Claims, 2 Drawing Sheets

POLISHED ROD FOR OIL WELL PUMPING

BACKGROUND OF THE INVENTION

When an oil well is first drilled into an oil producing subterranean formation the formation pressure is usually sufficient to force formation fluids to the earth's surface. This is referred to in the industry as a "flowing" well. In some areas of the world, such as in the Arabian Peninsula, formations pressures are exceedingly high and oil wells flow for extended lengths of time. In other parts of the world, such as in the Continental United States, oil producing formations typically do not have high formation pressures, therefore, even though most wells when first drilled will flow for a time, eventually, much of the oil derived from subterranean formations must be pumped to the earth's surface.

Several different types of pumping systems are employed in the petroleum industry, such as centrifugal pumps operated by electrical motors affixed to the bottom of tubing string extending from the earth's surface. However, the most common means of pumping oil from a producing oil well is by the use of a string of sucker rods extending from the earth's surface down to a subterranean pump that is vertically reciprocated. The pump is connected to the lower end of a string of tubing so that by reciprocation of the sucker rod string the pump lifts production fluid from the subterranean formation to the earth's surface. To reciprocate a string of sucker rods, a pumping unit is employed at the earth's surface, typically having a beam that pivots in a vertical plane with a horse-head at one end having attached to it short length cables that are affixed at their lower ends to a polished rod clamp. A polished rod is supported by the clamp and extends through a stuffing box. The lower end of the polished rod is attached to the string of sucker rods. The polished rod has a smooth exterior surface and reciprocates within the stuffing box. The function of the stuffing box is to force formation fluid that is lifted to the earth's surface to flow from the well tubing to a collection conduit by which the produced fluid is conveyed to a tank battery, pipeline or other system whereby the produced fluid is collected.

For background information relating to the use of a polished rod in an oil well pumping application reference may be had to United States patent application Ser. No. 08/465,833 entitled "Shock Absorber and Wiper" filed Jun. 6, 1995. This application is incorporated herein by reference. FIG. 1 of this application illustrates a typical pumping unit and shows a polished rod reciprocated through a stuffing box.

A sucker rod string is formed by a series of individual sucker rods, each about twenty-five (25) feet in length. A typical sucker rod has a male thread on each end. To connect the sucker rods together a short length coupling has female threads at both ends. Some older sucker rods were made with a box and pin arrangement, that is, wherein the sucker rod had an integral female thread at one end and a integral male thread at the other end so that the rods could be connected together without the use of intervening couplings. In more recent times, the standard procedure is to employ sucker rods have male threads at both ends.

The size of a sucker rod string varies according to the condition of the well in which the string is employed. A primary factor is the depth of the well. If the depth is relatively shallow, such as less than 3 or 4 thousand feet, a smaller diameter sucker rod can be employed. As the depth increases, the diameter of the sucker rod must increase since the sucker rod string must support itself as well as the column of fluid being moved from the subterranean formation to the earth's surface. Accordingly, sucker rod strings employ couplings having different size female threads. In the United States, sucker rods usually have couplings with thread size that are either ⅝"; ¾"; ⅞"; or 1". These are American Petroleum Institute size designations.

Attached to the upper end of the string of sucker rods is a polished rod as has been described in application Ser. No. 08/465,833, previously identified. The size of a polished rod must be selected in accordance with the load that it is to bear and to match the stuffing box in which it is employed. The outside diameter of the polished rod is typically employed in the United States and are 1⅛"; 1¼"; and 1½". Each size polished rod is employable with more than one size of sucker rods. As an example, a 1⅛" polished rod can be used with a sucker rod string having a ¾" pin or ⅝" pin size. A 1¼" polished rod can be employed with a sucker rod string having a ⅞" pin or a ¾" pin size. A 1½" polished rod can be employed with a sucker rod string having a ⅞" pin or a 1" pin size.

Because polished rods having different diameters, each diameter being used for a plurality of sucker rod sizes, an oil field supply warehouse must stock polished rods of varying diameters and for each diameter, a plurality of thread sizes. For instance, if a warehouse stocks 1⅛"; 1¼" and 1½" polished rods the warehouse will typically have each size rod available in two different pin sizes requiring an inventory of six different size/pin specifications for each length of polished rod. Lengths of polished rods can vary considerably. Typical lengths of polished rods are 8', 11', 16', 22', 26', 30' and 36'.

Further, polished rods are available with different metallurgical characteristics. The most common polished rod is of piston steel. Some are of alloy steel and others have a hard face covering.

When a variety of metallurgic types are stocked in a variety of sizes and lengths, and each size, length and type required two different pin sizes, it can be seen that a large number of different types of polished rods must be stocked, creating an inventory problem and space problem. The object of the present invention is to provide means of reducing by approximately one-half the inventory and space requirements for stocking polished rod for use in the petroleum industry. This invention will also help the oil companies by eliminating the confusion in the field over which thread size they need for each oil well.

This invention eliminates the need for a change-over coupling.

When oil companies have to increase the size of their sucker rods, due to more water in the oil well, the need for a new and larger pin size is not necessary with this invention. This requirement is satisfied by turning the polished rod around rather than having to buy a new conventional polished rod and the expenses involved with cost, delivery and installation.

SUMMARY OF THE INVENTION

This invention provides an improved polished rod for oil well pumping, particularly characterized by reducing inventory and warehouse space requirements. The polished rod is an elongated high strength cylindrical metal rod, the body portion being of uniform external diameter. The body portion has a smooth exterior surface adaptable for vertical reciprocation in a stuffing box. The exterior surface is also adaptable to receive a clamp thereon by which the polished rod is reciprocated by an oil well pumping unit. The function of the polished rod is to provide reciprocation of a string of sucker rods attached its lower end, the sucker rod string being in turn attached to a downhole pump by which fluid is lifted from a subterranean formation to the earth's surface.

The polished rod has first and second ends each having a male threaded end portion. Either of the male threaded end portions can be threadable attachment to a female threaded upper end of a string of sucker rods. The first end portion has a thread of a first size for attachment to a sucker rod string having a female thread of a first mating size. The second end portion has a male thread of a second size for attachment to a sucker rod string having a female thread of a second mating size. Thus, a single polished rod is adaptable for use with two different size sucker rod strings. To convert the polished rod for use from one size sucker rod string to another size sucker rod string the only requirement is that the elevational position of the polished rod be inverted, the polished rod otherwise functioning exactly the same irrespective of the size of sucker rod string to which it is attached.

This invertible polished rod that is capable of employment with two different size sucker rod strings therefore substantially reduces the inventory requirement for polished rods and therefore storage space requirements.

A better understanding of the invention will be obtained by the following description of the preferred embodiment, taken in conjunction with the attached drawings.

BRIEF DESCRIPTION OF THE DRAWINGS

FIG. 1 illustrates a polished rod of a defined metallurgical characteristic, that is "piston steel" and having a body size of a specified diameter of 1¼" and a length of 8'. The polished rod is identified as having a ⅞" pin on one end and a ¾" pin on the opposite end.

DETAILED DESCRIPTION OF THE PREFERRED EMBODIMENTS

Figure 2:
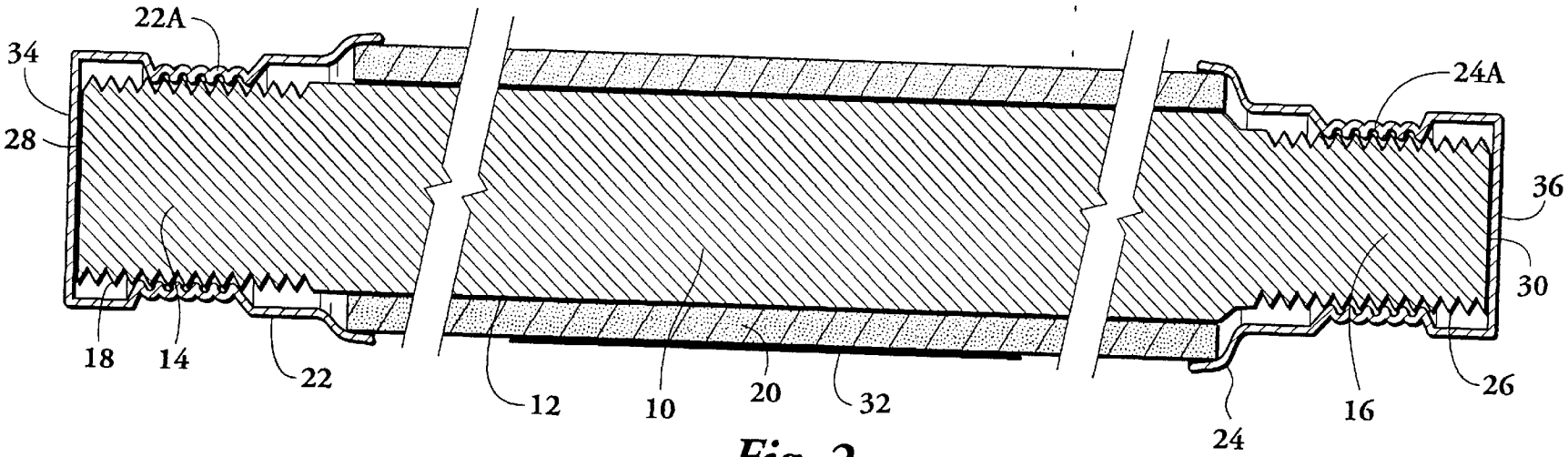
FIG. 2 is a cross-sectional view taken along the line of 2—2 of FIG. 1 and showing the relationship between the polished rod, the protective liner and the thread protectors position on the opposed ends.
Figure 1:
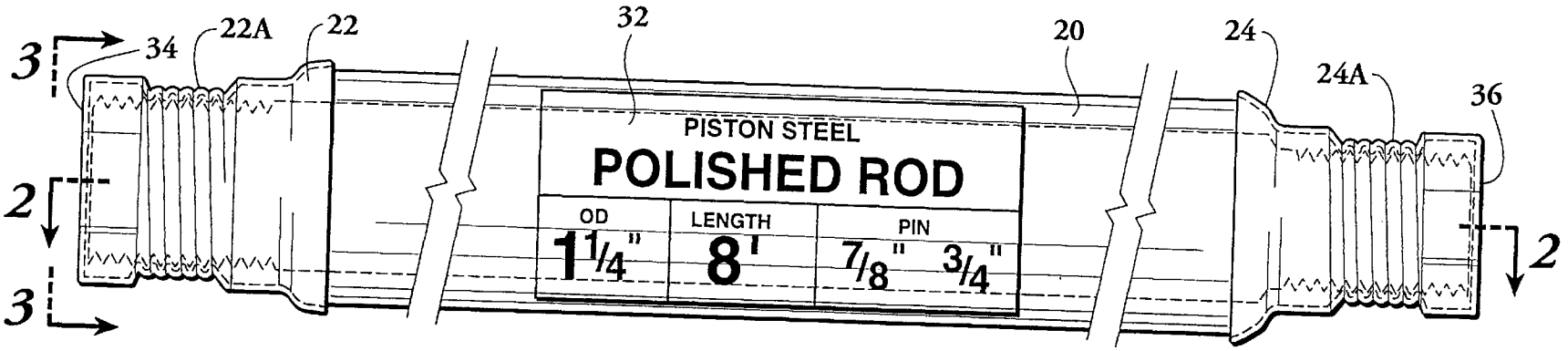
FIG. 1 is an elevational broken-away external view of a polished rod covered by a protective liner and having thread protectors on each end as supplied by a manufacturer and as stored by an oil field supply warehouse ready for delivery to an oil producer for installation in an oil well pumping unit.

Referring to the drawings and first to FIGS. 1 and 2, a polished rod having the advantages of the present invention is indicated by the numeral 10. Polished rod 10 is a long, straight cylinder of high strength metal used for transferring vertical motion between an oil well pumping unit and a string of sucker rods in a manner to be described later. Polished rod 10 has a smooth polished external surface 12, that is reciprocated within a stuffing box, also to be described subsequently. A typical stuffing box includes non-metallic packing that slidably receives the polished rod external surface 12, the packing serving to prevent the flow of liquids or gases past the polished rod.

Since the external surface 12 must reciprocate within packing in a stuffing box, the surface 12 must be very smooth, that is "polished" and thus the derivation of the common term "polished rod" to identify this product commonly employed in the petroleum industry. The polished rod 10 has a first male threaded end portion 14 on one end thereof and a second male threaded end portion 16 on the opposite end. Threaded end portions 14 and 16 are designed and configured to engage the female threaded end portion of a sucker rod coupling (not shown) whereby a string of sucker rods is suspended from the vertically oriented polished rod. First threaded end portion 14 has external threads 18 of a selected size. Typically polished rods of the type illustrated in FIGS. 1 and 2 have a thread size designated as a ⅝"; ¾"; ⅞" or 1". These are American Petroleum Institute nominal sizes. For instance a ⅝" pin size would typically have a 15/16" OD or major diameter. A ¾" nominal pin size typically has a 1 1/16" major diameter; a ⅞" pin size typically has a 1 3/16" major diameter; and a 1"pin size has a 1⅜" major diameter. The nominal sizes, that is ⅝", ¾", ⅞" and 1" are what is referred to in the terminology of threaded devices as being the "pitch diameter". In the American Petroleum Institute standards, the pitch diameter, that is ⅝", ¾", ⅞" or 1" is typically the diameter that is intermediate the thread minor diameter and the thread major diameter. The minor diameter is the diameter at the base of the thread and the major diameter the diameter at the apex of the thread, that is, the thread OD.

The typical diameter of the polished rod external surface 12 utilized in the petroleum industry, particularly in the Continental United States, 1⅛", 1¼" or 1½". The typical polished rod of 1⅛" diameter has either a ⅝" or ¾" pin size. A 1¼" polished rod has a ¾" or ⅞" pin size. A 1½" polished rod has a pin size of ⅞" or 1".

In the past, all polished rods known to Applicant have had the same size thread on both of the opposed first and the second threaded end portions 14 and 16. By this invention different thread sizes are provided on the opposed ends of the polished rods. The number of polished rods that must be stocked by a distributor or supplier, such as an oil field supply house is thereby reduced by about 50%. By reducing the number of polished rods which must be stocked, the distributor is thereby enabled to reduce the cost of its inventory of polished rods by 50% without diminishing in any respect its ability to immediately respond to a customers need. Further, by reducing the number of polished rods required in inventory the space required in a warehouse is reduced by about 50%.

Oil field supply warehouses, to meet a variety of customers needs must stock a large number of polished rods. This is due to the fact that polished rods vary in four (4) basic ways. First, they vary in diameter of polished surface 12, that is, typically, 1⅛", 1¼" and 1½". Second, they vary in length such as 8', 11', 16', 22', 26', 30' and 36'. Third, they vary in composition, that is a polished rod can be for piston steel or an alloy, such as a nickel alloy, to resist corrosion or can be a piston steel rod with a hard faced coating, such as a HASCO-LOY, a registered trademark of Hasco Manufacturing Co., of Sapulpa, Okla. Fourth, polished rods must be stocked with alternate pin sizes for each sucker rod size with which it is used. Thus it can be seen that a combination of these four (4) different variables must be met to supply a customer's requirement for a particular pumping well. This means that a large number of polished rods must be stocked by a typical oil field supply warehouse. By the advantage of this invention, the number of polished rods that must be maintained by a warehouse can be reduced by approximately one-half.

Only one end portion of a polished rod is used in pumping an oil well, that is, the lower end portion is used since the lower end portion is affixed to a string of sucker rods. The upper end portion of the polished rod, whether it is first portion 14 or second portion 16 depending on the vertical orientation of the rod, is not used during a pumping application. This is due to the fact that the polished rod is not engaged by the pumping unit by making use of an upper threaded end portion. The polished rod is engaged by a polished rod clamp, (to be explained later), that is secured to the polished rod external surface 12. Therefore the upper threaded end portion of a polished rod is not important in pumping an oil well. In some instances, when an oil well is "pulled", that is, when the sucker rod string is removed from the well to repair or replace a pump, a cable from a pulling unit has a device that is attached to the upper threaded end portion of the polished rod. This is done for only a very short time, that is, the time to lift the sucker rod string so that it first extends out of the well, after which the sucker rod string itself is engaged by the pulling unit.

Figures 3, 4:
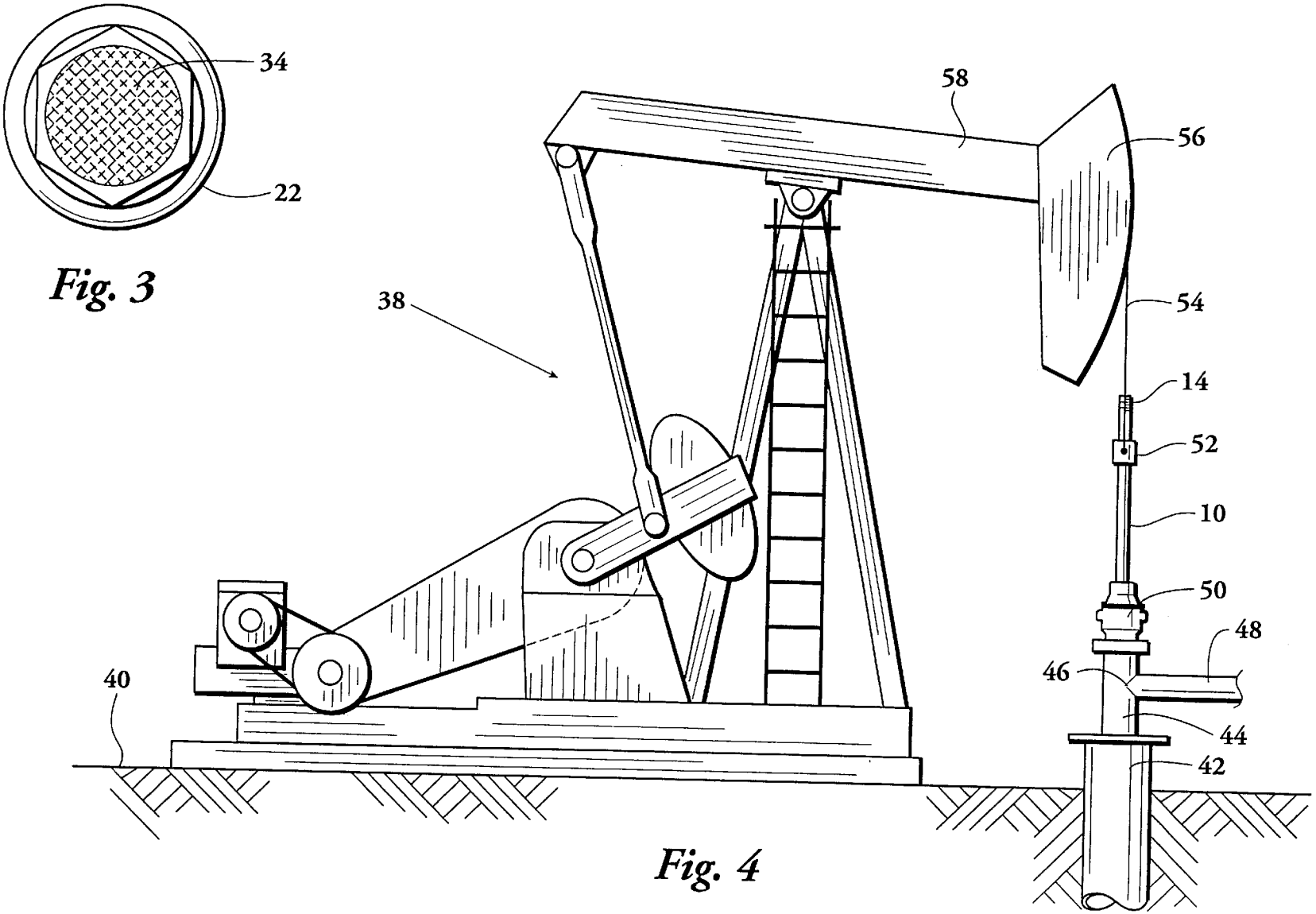
FIG. 3 is an end view of the polished rod taken along the line 3—3 of FIG. 1 showing the use of a color coding on the end of a thread protector and illustrating one aspect of the color code system employed for the polished rod.
FIG. 4 is an elevational view of an oil well pumping unit showing the environment in which the polished rod of FIGS. 1 and 2 is employed.

FIGS. 1 and 2 show a protective non-metallic tube or sleeve 20 that can be of heavy paper that fits over the polished rod after it is manufactured to protect the polished exterior surface 12. Further FIGS. 2 and 3 show a first thread protector 22 secured on first thread end portion 14 and a second thread protector 24 secured on the second threaded end portion 16. Thread protectors 22 and 24 are usually made of steel and have integral threads 22*a* and 24*a* respectively to threadably engage threads 18 on threaded end 14 and threads 26 second threaded end portion 16. The function of thread protectors 22 and 24 is, as the name implies, to protect the threads on the polished rod. Further, they are configured to hold tube 20 in position. When the polished rod is ready to be used, tube 20 and thread protectors 22 and 24 are discarded although they are subject to being reused.

An important feature of the invention is a color coded means of insuring proper usage out of the polished rod. Each thread size is assigned a color code. As an example, the following color code is applicable:

| Size | Color |
|---|---|
| ⅝" | red |
| ¾" | yellow |
| ⅞" | orange |
| 1" | blue |

The planer end surface 28 of first threaded end portion 14 is painted a color code corresponding to the size of threads 18. In like manner, the planer end 30 of second threaded end portion 16 color coded to identify the size of threads 26. For instance, if polished rod 10 of FIGS. 1 and 2 is a 1¼" size, as identified by the label 32 in FIG. 1. The size of the threads 18 on first threaded end portion 14 is identified as ⅞" in which case the polished rod end 28 is painted orange. The size of threads 26 on the second threaded end portion 16 is ¾" and therefore surface 30 is painted yellow. Further, these end surfaces are preferable directly stamped with the size, that is ⅞" and ¾" respectively.

In like manner, the thread protectors 22 and 24 are color coded. Specifically, the planer end surface 34 of first thread protector 20 is painted orange as indicated in FIG. 3. The planer end 24, since it fits on a ¾" pin size is also painted yellow to match pin end 30.

A further color code is employed to identify the size, that is, the diameter of the polished rod. This achieved by providing a label 32 having a background color indicating the diameter size. The label 32 in FIG. 1 indicates a 1¼" rod. The label 32 is green (not color coded in the drawing) according to the following color code:

| Diameter of polished rod | Color of Label |
|---|---|
| 1 ⅛" | red |
| 1 ¼" | green |
| 1 ½" | blue |

In this way a warehouseman, or the ultimate user of the polished rod, can quickly identify by the color of label 32 the diameter of polished rod and by the colors on the ends of 34 and 36 of the thread protectors the thread sizes of the end portions. This combination of color codes serves to prevent mistake both in supplying polished rods and in making actual use of them.

FIG. 4 shows the environment in which a polished rod of this invention is employed. A typical oil well pumping unit 38 is shown resting on the earth's surface 40. A casing 42 extends into the earth. A string of tubing 44 received within casing 42 functions to conduct pumped fluid to the earth's surface. Attached to the upper end of tubing 44 is a pumping tee 46 providing connection to a flow line 48 by which the pumped fluid is conveyed to a tank, pipeline or other means of making use of the produced fluid.

Affixed to the upper end of pumping tee 46 is a stuffing box 50.

Received within tubing 44 is a sucker rod string (not seen) which extends from several hundred feet to as much as 10,000 feet into the earth to a pump (not shown) which is reciprocated as the sucker rod string is reciprocated. Attached to the upper end of the sucker rod string is the polished rod 10. The polished rod, in conjunction with stuffing box 50, provides a means of sealing off the upper end of the pumping tee 46 so that produced fluid does not flow out into the environment but is retained and is conveyed through flow line 48. Stuffing box 50 includes non-metallic packing (not seen). Since polished rod 10 is reciprocated vertically within stuffing box 50 the highly polished surface on the exterior, as previously discussed, is necessary to reduce the wear on the packing.

Secured to polished rod 10 is a polished rod clamp 52. Attached to clamp 52 is a cable harness 54 extending from a horsehead 56 attached to the outer end of a beam 58. In the orientation of polished rod 10 in FIG. 4 the sucker rod string (not seen) is attached to the polished rod second threaded end portion while the first end portion 14 extends above polished rod clamp 52. It can thus be seen that the size of first threaded end portion 14 is not involved in the use of the polished rod in the application as shown in FIG. 4. On the other hand, if the sucker rod string had a thread size corresponding to that of first threaded end portion 14 then all that would be necessary in installation of the polished rod 10 would be to merely invert it. Thus FIG. 4 demonstrates the adaptability of a polished rod of this disclosure to meet the requirements of a pumping well in a way to enable a warehouseman to stock approximately ½ of the polished rods traditionally required.

Whereas, the present invention has been described in relation to the drawings attached hereto, it should be understood that other and further modifications, apart from those shown or suggested herein, may be made within the spirit and scope of this invention.

What is claimed is:

1. An improved polished rod for use in pumping a well and having the characteristic of reducing inventory and warehouse space requirements, comprising:

an elongated high strength cylindrical metal rod of uniform external diameter, having a smooth exterior surface adaptable for vertical reciprocation in a stuffing box, the exterior surface further being adaptable to receive a clamp thereon by which the polished rod is reciprocated, and having male threaded end portions at first and second ends thereof, either of which may be employed for threadable attachment to a female threaded upper end of a string of sucker rods suspended therefrom, the first end portion having a thread of a first size for attachment to a sucker rod string having a female thread of a mating first size and the second end portion having a thread of a second size for attachment to a sucker rod string having a female thread of a mating second size.

2. An improved polished rod according to claim 1 wherein said polished rod has a substantially planar end terminating each of said first and second end portion, the planar ends being painted different colors according to a code to identify different thread sizes.

3. An improved polished rod according to claim 1 including first and second short length thread protectors threadably positioned on said first and second threaded end portions respectively, each thread protector having an external end surface, the end surface of each thread protector having a color according to a code identifying the thread size of the threaded end portion on which the thread protector is positioned.

4. An improved polished rod according to claim 2 including first and second short length thread protectors threadably positioned on said first and second threaded end portions respectively, each thread protector having an external end surface, the end surface of each thread protector having a color according to a code identifying the thread size of the threaded end portion on which the thread protector is positioned and wherein the color on each said thread protector external end surface conforms to the color on said planar end of a said polished rod end portion on which the thread protector threadably fits.

5. An improved polished rod according to claim 1 including:

a protective non-metallic tube slidably received on said polished rod, the tube having a color indicia thereon indicating by a code said polished rod diameter.

6. An improved polished rod according to claim 3 including:

a protective non-metallic tube slidably received on said polished rod, the tube being retained between said first and second thread protectors, the tube having a color indicia thereon indicating by a code said polished rod diameter whereby the diameter and the thread sizes of the opposed threaded end portions are all indicated by a color code.

* * * * *